US006995604B2

(12) United States Patent
Puma et al.

(10) Patent No.: US 6,995,604 B2
(45) Date of Patent: Feb. 7, 2006

(54) CURRENT SOURCE CIRCUIT FOR GENERATING A LOW-NOISE CURRENT AND METHOD OF OPERATING THE CURRENT SOURCE CIRCUIT

(75) Inventors: Giuseppe Li Puma, Bochum (DE); Petra Schubert, Solingen (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/703,065

(22) Filed: Nov. 6, 2003

(65) Prior Publication Data

US 2004/0095188 A1 May 20, 2004

(30) Foreign Application Priority Data

Nov. 6, 2002 (DE) ..... 102 51 695

(51) Int. Cl.
*G05F 1/10* (2006.01)
*G05F 3/02* (2006.01)

(52) U.S. Cl. ..... 327/543; 327/157

(58) Field of Classification Search ..... 327/148, 327/157, 543
See application file for complete search history.

(56) References Cited

U.S. PATENT DOCUMENTS

| | | | | |
|---|---|---|---|---|
| 6,160,432 | A * | 12/2000 | Rhee et al. | 327/157 |
| 6,163,187 | A * | 12/2000 | Sano | 327/157 |
| 6,236,252 | B1 | 5/2001 | Genest et al. | 327/178 |
| 6,586,976 | B2 * | 7/2003 | Yang | 327/157 |
| 2002/0017136 | A1 * | 2/2002 | Morimura et al. | 73/514.32 |

FOREIGN PATENT DOCUMENTS

| | | |
|---|---|---|
| DE | 689 21 852 T2 | 6/1990 |
| EP | 0 371 790 B1 | 6/1990 |

* cited by examiner

*Primary Examiner*—Quan Tra
(74) *Attorney, Agent, or Firm*—Laurence A. Greenberg; Werner H. Stemer; Ralph E. Locher

(57) ABSTRACT

A current source circuit for generating a low-noise current has a current mirror circuit with a first and a second transistor. The current mirror circuit contains a capacitor connected between a source connection and a gate connection of the second transistor. The current mirror circuit likewise contains a switching element disposed between a drain connection of the first transistor and the gate connection of the second transistor. The switching element may be controlled as a function of an operating state of the current source circuit.

6 Claims, 1 Drawing Sheet

CURRENT SOURCE CIRCUIT FOR GENERATING A LOW-NOISE CURRENT AND METHOD OF OPERATING THE CURRENT SOURCE CIRCUIT

BACKGROUND OF THE INVENTION

1. Field of the Invention

The present invention relates to a current source circuit for generating a low-noise current, to a method for operating a current source circuit of this type, and to use in a phase-locked loop.

Current source circuits are, of course, frequently utilized in integrated semiconductor modules. In communications technology, they are used, in particular, in charge pumps for phase-locked loops. Phase-locked loops are themselves simple implementations of transmission concepts which use frequency modulation, for example in modern mobile radio systems or alternatively in other wire-based communications systems.

The choice of bandwidth in a communications system is, in principle, a fundamental factor. On the one hand, noise requirements, in particular compliance with the spectral transmit mask, must be observed, thus signifying the choice of a narrow bandwidth. In contrast thereto, transmission of the modulated data requires a wide bandwidth. An important noise source within the communications system is constituted by the charge pump in the phase-locked loop and the current source circuit in the charge pump, with the result that it is important, for the purposes of the above considerations, to reduce their noise influence.

Circuit configurations for phase-locked loops frequently use an integrating loop filter, so that the charge pump ideally does not supply a charge pulse in the locked state of the phase-locked loop. However, spurious charge pulses occur in practice, for example on account of leakage currents. The pulse width of the output current pulse in conventional systems is minimized in order to reduce the influence on phase noise of the phased-locked loop. In addition, a current mirror is used in the current source circuits in order to obtain a stable output current. The dominant noise sources within the current source circuits are the reference resistor and also the current mirror transistors.

SUMMARY OF THE INVENTION

It is accordingly an object of the invention to provide a current source circuit for generating a low-noise current and a method of operating the current source circuit that overcome the above-mentioned disadvantages of the prior art devices and methods of this general type, which reduces the noise influence caused by the current source circuit.

With the foregoing and other objects in view there is provided, in accordance with the invention, a current source circuit for generating a low-noise current. The current source circuit has a current mirror circuit. The current mirror circuit contains transistors, including a first transistor and a second transistor. The transistors each have a source connection, a drain connection, and a gate connection. A capacitance is connected between the source connection and the gate connection of the second transistor. A switching element is connected between the drain connection of the first transistor and the gate connection of the second transistor and is controlled in dependence on an operating state of the current source circuit.

A fundamental concept of the invention involves using the advantages of a current mirror in the switched-on phase and subsequently establishing the stability and lower dependency on thermal noise of a single transistor.

In accordance with an added feature of the invention, a resistor is provided and a current sink is connected to the resistor. The drain connection of the second transistor functions as a current output of the current source circuit. The current output is connected to the current sink through the resistor.

In accordance with a further feature of the invention, the current sink has a further current mirror containing further transistors, including a first further transistor and a second further transistor. The further transistors each have a source connection, a drain connection, and a gate connection. A further capacitance is connected between the source connection and the gate connection of the second further transistor. A further switching element is connected between the drain connection of the first further transistor and the gate connection of the second further transistor. The further switching element is controlled in dependence on an operating state of the current source circuit.

Ideally, the current source circuit is used in a charge pump of a phase-locked loop.

With the foregoing and other objects in view there is further provided, in accordance with the invention, a method for operating a current source circuit for generating a low-noise current. The current source circuit contains a current mirror circuit having a first transistor, a second transistor, a capacitance connected between a source connection and a gate connection of the second transistor, and a switching element connected between a drain connection of the first transistor and the gate connection of the second transistor and the switching element is controlled in dependence on an operating state of the current source circuit. The method includes the step of closing the switching element during a switched-on phase of the current source circuit.

In accordance with an additional mode of the invention, there are the steps of setting a duration of the switched-on phase to ensure that a target current intensity of the current source circuit is reached or that a target voltage across the capacitance is reached; and opening the switching element after the switched-on phase.

Other features which are considered as characteristic for the invention are set forth in the appended claims.

Although the invention is illustrated and described herein as embodied in a current source circuit for generating a low-noise current and a method of operating the current source circuit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
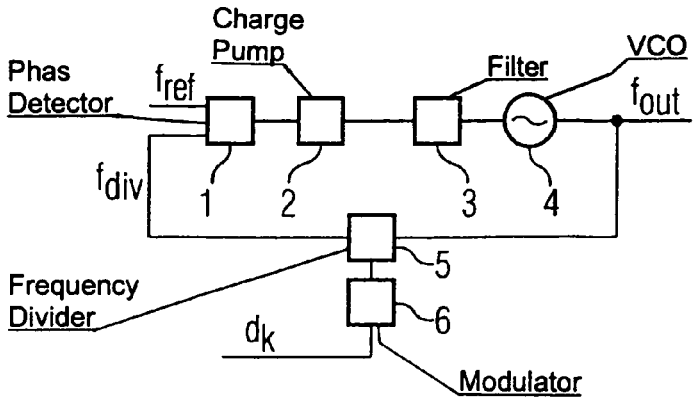
FIG 1 PRIOR ART
FIG. 1 is a schematic block diagram of a known $\Sigma/\Delta$ phase-locked loop.

Referring now to the figures of the drawing in detail and first, particularly, to FIG. 1 thereof, there is shown a block diagram of a known Σ/Δ phase-locked loop. The phase-locked loop has a phase detector 1 with a first input for a reference frequency $f_{ref}$. A charge pump 2 and a loop filter 3 are connected to an output of the phase detector 1. On the output side, the loop filter 3 is connected to a voltage-controlled oscillator 4. A second path is routed back from the frequency output of the voltage-controlled oscillator 4 to a second input of the phase detector 1 via a frequency divider 5. The frequency divider 5 is driven by a Σ/Δ modulator 6.

The principle of a phase-locked loop is that a control voltage which is supplied to the voltage-controlled oscillator 4 is generated, by the phase detector 1 and the charge pump 2, from the reference frequency $f_{ref}$ which is fed in at a first input and is obtained from a non-illustrated stable reference oscillator, and from a divider frequency $f_{div}$ which is fed in at a second input. As a function of the control voltage, the voltage-controlled oscillator 4 generates an output frequency $f_{out}$ that corresponds to a desired frequency-modulated carrier signal. The output frequency $f_{out}$ from the voltage-controlled oscillator 4 is supplied to the frequency divider 5. The output signal from the frequency divider 5 corresponds to the divider frequency $f_{div}$ that is passed back to the phase detector 1 again. The frequency divider 5 is driven by a Σ/Δ modulator 6 which, for its part, is driven by digital data $d_k$ that are to be converted to the frequency-modulated carrier signal $f_{out}$.

Figure 2:
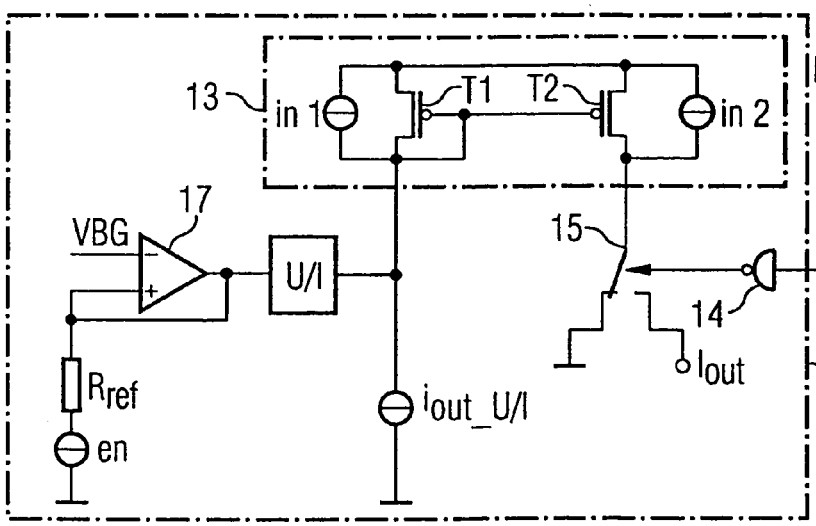
FIG 2 PRIOR ART
FIG. 2 is a basic circuit diagram of a known current source circuit in a conventional charge pump.

FIG. 2 shows a basic circuit of a current source circuit in a charge pump. FIG. 2 shows a phase detector 11 which, from the comparison of the reference frequencies $f_{ref}$ with the divider frequency $f_{div}$, passes a control signal to a charge pump 12 (surrounded by a broken line). In the charge pump 12, the control signal is passed via an inverter 14 to a switch 15 which can switch a current from a current mirror 13 (surrounded by a broken line) through to a current output $I_{out}$ or can pass it to an earth connection.

For its part, the current mirror 13 is supplied with a control current that is composed of a fixed operating current $i_{out}$_U/I and an output current from a voltage/current converter U/I. On the input side, the voltage/current converter U/I is connected to a voltage output of an operational amplifier 17. The potential at the voltage output results from the comparison of an input voltage VBG with a contact voltage en. The input voltage VBG is supplied to a first voltage input of the operational amplifier 17, while the contact voltage en is supplied via a reference resistor $R_{ref}$ to a second voltage input of the operational amplifier 17.

The current mirror 13 contains a current mirror transistor T1 whose drain and gate connections are connected to a common potential, a current source transistor T2 and two current sources in1 and in2 which each generate a voltage at the drain/source connections of the current mirror transistor T1 and of the current source transistor T2.

As a result of the fact that the drain connection and the gate connection of the current mirror transistor T1 are set to the same potential, the transistor effectively acts as a diode. In an implementation using bipolar technology, the diode is an npn diode, while, in the case of the current mirror transistor T1 being implemented as a field effect transistor, for example using CMOS technology, the diode is an n-channel diode.

In a conventional charge pump, the dominant noise variables may be regarded as being the reference resistor $R_{ref}$ and also the current mirror transistor T1 and the current source transistor T2. The noise is amplified by a current mirror factor M. A small current mirror factor M is thus sought in order to minimize the noise, but this considerably increases the current drawn.

Figure 3:
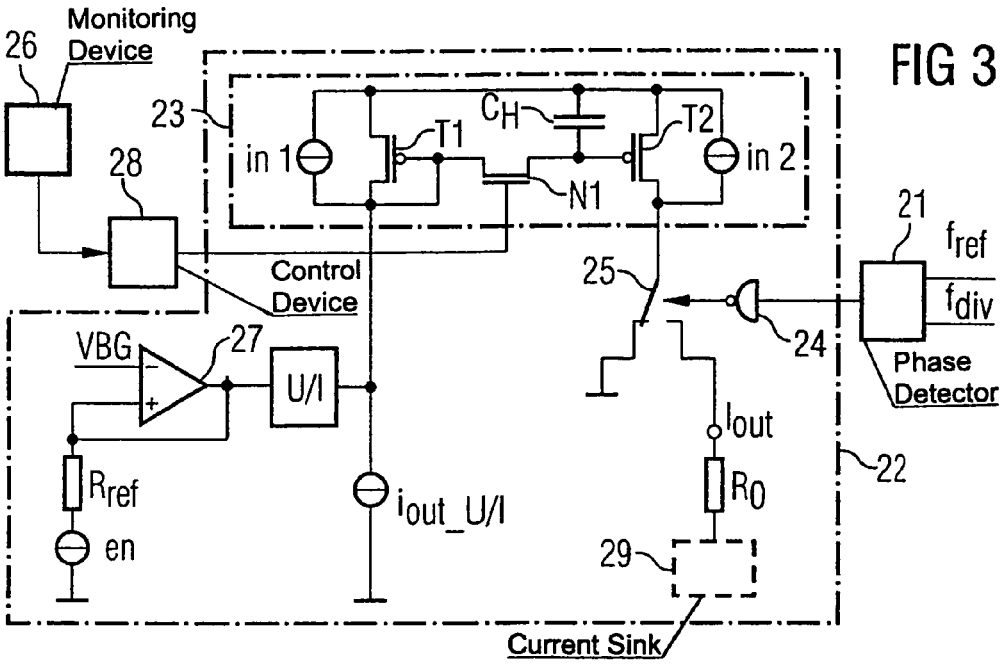
FIG. 3 is a basic circuit diagram of a current source circuit in a charge pump for generating a low-noise current according to the invention.

FIG. 3 shows the basic circuit diagram of a low-noise charge pump in accordance with one embodiment of the present invention. FIG. 3 shows, in addition to a phase detector 21, a functional unit of a charge pump 22 (surrounded by a broken line) that corresponds to the charge pump 12 shown in FIG. 2. By comparing a reference frequency $f_{ref}$ and a divider frequency $f_{div}$, the phase detector 21 supplies a control signal to the charge pump 22. The latter receives a switching signal from a control device 28 that, for its part, is controlled by an operations monitoring device 26.

The charge pump 22 has a current mirror circuit 23 (surrounded by a broken line) that differs from the conventional current mirror circuit 13 shown in FIG. 2.

The current mirror circuit 23 receives a control current that is composed of an output current from a voltage/current converter U/I and of a fixed operating current $i_{out}$_U/I. On the input side, the voltage/current converter U/I is connected to a voltage output of an operational amplifier 27. The potential at the voltage output results from the comparison of the input voltage VBG with the contact voltage en. The input voltage VBG is supplied to a first voltage input of the operational amplifier 27, while the contact voltage en is supplied via a reference resistor $R_{ref}$ to a second voltage input of the operational amplifier 27.

The current mirror circuit 23 contains a current mirror transistor T1 and a current source transistor T2 and also two current sources in1 and in2. The current source transistor T2 operates as a constant current source, in which case it is possible for a drain current to be selectively output to a current output $I_{out}$ or to an earth connection via a switch 25. The switch 25 is actuated by the control signal that is output from the phase detector 21 and is routed via an inverter 24. The current output $I_{out}$ is connected to a current sink 29 via a tapping resistor $R_0$.

In addition to the conventional implementation shown in FIG. 2, the current mirror 23 contains a capacitance $C_H$ and a switch-on transistor N1 serving as a connecting switching element. The capacitance $C_H$ is connected in parallel with the source-gate path of the current source transistor T2. The source-drain path of the switch-on transistor N1 is connected between the gate or drain potential (which are connected to one another), respectively, of the current mirror transistor T1 and the capacitance $C_H$ or, respectively, the gate of the current source transistor T2.

If the switch-on transistor N1 is switched off, a turn-on voltage which is defined by the charge applied to the capacitor $C_H$ is present between the source and the gate of the current source transistor T2, and the current source transistor T2 passes a corresponding current on its source-drain path. When the switch-on transistor N1 is turned on, the voltage potential between the source and gate of the current source transistor T2 is determined by the current mirror transistor T1. The capacitor $C_H$ charges and simultaneously acts as a low-pass filter.

The gate of the switch-on transistor N1 is connected to the control device 28 which can switch the switch-on transistor N1 on or off by applying a switching potential to the gate of the latter. The control device 28 is driven by the operations monitoring device 26. During start-up, the charge pump 22 can thus initially use the entire current mirror 23 while the capacitor $C_H$ is being charged. During start-up of the current source circuit, the noise influence is still very low since the noise is essentially determined by the thermal noise of the reference resistor $R_{ref}$ and the effective resistances of the current mirror transistor T1 and the current source transistor T2. The linear current response of the current mirror 22 to the control current may thus be used.

As soon as the charge pump has reached a certain target current intensity or a certain charge on the capacitor $C_H$, the switch-on transistor N1 is switched off. The current source transistor T2 is thus used as the sole current source, and the noise of the entire current source circuit is determined solely by the noise of the current source transistor T2.

The capacitor $C_H$ will discharge during operation of the charge pump 22, with the result that, when the charge falls below a critical value, the charge pump 22 is turned off or the switch-on transistor N1 is switched on for the purpose of charging the capacitance $C_H$. The capacitance $C_H$ is preferably configured in such a manner that the discharge time is considerably longer than the typical operating time of the charge pump. The capacitance $C_H$ should therefore be chosen to be as small as possible. In one simple implementation, the capacitance $C_H$ may be formed by the parasitic capacitances at the nodes.

The switch-on transistor N1 is preferably an n-channel MOS transistor so that it rapidly switches over from the on state to the off state. In addition, a digital switching signal can then be used in order to apply the control potential to the gate of the switch-on transistor N1. A switching signal value of 1 then corresponds to the gate being switched on, while a switching signal value of 0 switches off the switch-on transistor N1.

In previous implementations of phase-locked loops, use is frequently made of an integrating loop filter that is connected between the current output $I_{out}$ of the charge pump 3 and the voltage-controlled oscillator 4. In this case, an additional charge drain, such as the current sink 29, is required in the charge pump 3 for the purpose of discharging the loop filter capacitor in the integrating loop filter. A further branch having a current source transistor may be used for this purpose. The current source transistor may be an n-channel MOS transistor. The above-described current source circuit may likewise be used for the circuit of the current sink 29.

In many communications systems, for example in TDMA systems such as DECT or GSM, data are transmitted in the form of short data packets ("bursts"). In this case, it is advantageous if the operations monitoring device corresponds to the burst control device in the communications system. At the beginning of each reception or transmission burst, the current circuit is put into operation, that is to say the switch-on transistor N1 is opened and the capacitance $C_H$ is charged. It is advantageous to select the capacitance $C_H$ in such a manner that its discharge time is considerably longer than the burst duration in the communications system.

We claim:

1. A communication system for transmitting data in the form of short data packets (bursts), the communication system including a phase-locked loop (PLL) with a charge pump, the charge pump including a current source circuit for generating a low-noise current, the communication system comprising:

a current mirror circuit, containing:

transistors, including a first transistor and a second transistor, said transistors each having a source connection, a drain connection, and a gate connection;

a capacitance connected between said source connection and said gate connection of said second transistor; and a switching element connected between said drain connection of said first transistor and said gate connection of said second transistor and controlled in dependence on an operating state of the current source circuit;

a switching element control device for controlling the switching element;

an operations monitoring device corresponding to a burst control device of the communications system; and said switching element control device and said operations monitoring device being disposed to close said switching element at the beginning of each reception or transmission burst for a duration of a switched-on phase of the current source circuit.

2. The current source circuit according to claim 1, further comprising:

a resistor; and a current sink connected to said resistor, said drain connection of said second transistor functioning as a current output of said current source circuit, said current output connected to said current sink through said resistor.

3. The current source circuit according to claim 2, wherein said current sink has a further current mirror containing:

further transistors, including a first further transistor and a second further transistor, said further transistors each having a source connection, a drain connection, and a gate connection;

a further capacitance connected between said source connection and said gate connection of said second further transistor; and a further switching element connected between said drain connection of said first further transistor and said gate connection of said second further transistor and controlled in dependence on an operating state of the current source circuit.

4. A method for operating a current source circuit for generating a low noise current, the current source circuit being part of a charge pump, the charge pump being part of a phase-locked loop (PLL), the phase-locked loop being part of a communications system, the communications system being arranged for transmitting data in the form of short data packets (bursts), the current source circuit containing a current mirror circuit having a first transistor, a second transistor, a capacitance connected between a source connection and a gate connection of the second transistor, and a switching element connected between a drain connection of the first transistor and the gate connection of the second transistor and controlled by a control device in dependence on an operating state of the current source circuit, the control device being driven by an operations monitoring device corresponding to a burst control device of the communications system, the method which comprises the step of:

closing the switching element at the beginning of each reception or transmission burst for a duration of a switched-on phase of the current source circuit.

5. The method according to claim 4, which further comprises:

setting a duration of the switched-on phase to ensure that a target current intensity of the current source circuit is reached; and opening the switching element after the switched-on phase.

6. A communication system, comprising:

a charge pump including a current source circuit for generating a low-noise current and having a current mirror circuit, the current mirror circuit containing:

transistors, including a first transistor and a second transistor, said transistors each having a source connection, a drain connection, and a gate connection;

a capacitance connected between said source connection and said gate connection of said second transistor;

a switching element connected between said drain connection of said first transistor and said gate connection of said second transistor and controlled in dependence on an operating state of the current source circuit;

a control device for controlling said switching element;

an operations monitoring device corresponding to a burst control device of the communications system; and said switching element control device and said operations monitoring device being disposed to close said switching element at the beginning of each reception or transmission burst for a duration of a switched-on phase of the current source circuit.

* * * * *